United States Patent [19]

Roca-Nierga

[11] 4,432,326

[45] Feb. 21, 1984

[54] DEVICE FOR CONTROLLING THE ANGLE OF ADVANCE IN A FUEL-INJECTION PUMP OF AN INTERNAL-COMBUSTION ENGINE

[75] Inventor: Manuel Roca-Nierga, Barcelona, Spain

[73] Assignee: SPICA S.p.A., Leghorn, Italy

[21] Appl. No.: 368,117

[22] Filed: Apr. 14, 1982

[30] Foreign Application Priority Data

Apr. 18, 1981 [DE] Fed. Rep. of Germany ..... 3115718

[51] Int. Cl.[3] ..... F02M 59/20

[52] U.S. Cl. ..... 123/501; 123/502

[58] Field of Search ..... 123/502, 501, 387, 369

[56] References Cited

U.S. PATENT DOCUMENTS

| | | | |
|---|---|---|---|
| 2,947,299 | 8/1960 | Shallenberg et al. | 123/501 |
| 4,050,432 | 9/1977 | Davis et al. | 123/502 |
| 4,292,940 | 10/1981 | Bailey | 123/501 |
| 4,359,995 | 11/1982 | Mowbray | 123/502 |
| 4,366,796 | 1/1983 | Kaibara et al. | 123/502 |

FOREIGN PATENT DOCUMENTS

| | | | |
|---|---|---|---|
| 256000 | 1/1963 | Australia | 123/502 |
| 452671 | 12/1974 | U.S.S.R. | 123/502 |

*Primary Examiner*—Charles J. Myhre
*Assistant Examiner*—Magdalen Moy
*Attorney, Agent, or Firm*—Diller, Ramik & Wight

[57] ABSTRACT

The invention relates to a device for automatically controlling the start of the delivery of an injection-pump for an internal-combustion engine and comprises, as the control member, a tridimensional planar cam (24) mounted on a slider (10) for being shifted along a first direction as a function of the rate of flow of delivery of the fuel to the engine and, along a second direction, perpendicular to the former, as a function of the pump rpm.

11 Claims, 2 Drawing Figures

Figure 1:
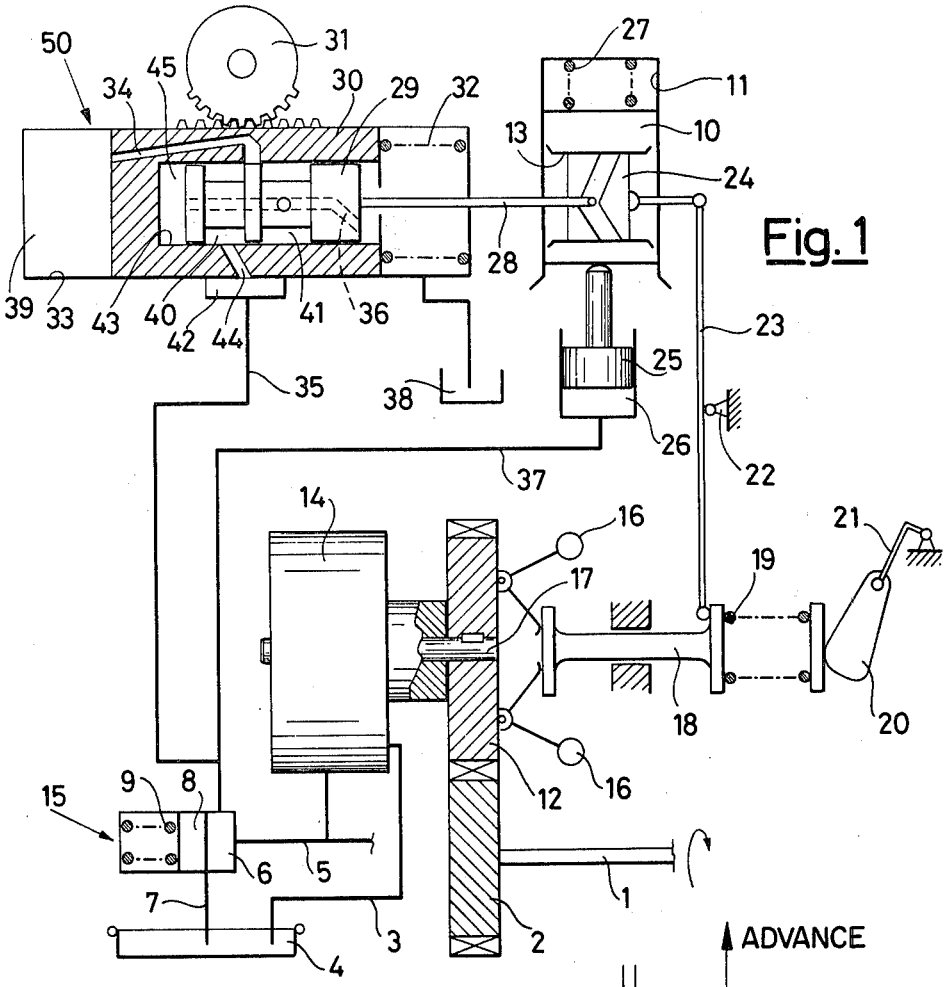

DEVICE FOR CONTROLLING THE ANGLE OF ADVANCE IN A FUEL-INJECTION PUMP OF AN INTERNAL-COMBUSTION ENGINE

This invention relates to fuel-injection pumps of the kind comprising a distributing piston, for internal-combustion engines, and equipped with a so-called automatic advance device, or with means capable of varying the instant of time of the start of the injection relative to the position of the mainshaft.

It is known that the fuel-injection pumps must enter action with a certain advance, in order to optimize the combustion process. Approaches are known long since by which, with the aid of a piston connected to a cam or a roller ring, said piston can be displaced so as to vary the instant of time at which the injection of fuel is started, that which is conventionally obtained by exploiting a force which is proportional to the pump rpm against the bias of a return spring.

In the present days, in order to reduce the emission of engine exhaust gases, it is required than an accurate physical law governs the advance as a function both of the speed and the load of the engine concerned.

In order that such a problem may be solved, hydraulic devices have been proposed, which, by varying the pressure which actuates said advance-regulating piston, afford a variability which is a function of both the load and the rpm of the pump.

Such hydraulic devices permit that variations may be obtained in a single direction only, by varying, or by decreasing the law of variation of the advance under full-load conditions, and, moreover, linear laws of variations must compulsorily be adopted because of the dependence on an elasticity constant of one or more springs.

An object of the invention, therefore, is to provide a device in which the advance is so controlled as to make possible an optimum selected of the advance values both as a function of the angular speed of rotation and as a function of the engine load, said device being characterized in that it comprises means responsive to the rpm of the feed pump which shift by a distance corresponding to said speed a slider on which a cam body is mounted, means responsive to the position of a member which controls the rate of delivery of the injection pump which shift by a distance corresponding to said rate of delivery the cam body on the slider in a direction perpendicular to the direction of displacement of the slider, a feeler resting continuously against said cam in a direction perpendicular to the direction of displacement of the slider and to the direction of displacement of the cam on the slider, said feeler controlling by its position a member for controlling the start of the delivery of the injection pump.

The selection of the type of tridimensional cam has been directed towards the adoption of a planar system due to the ease of transferring into Cartesian coordinates the laws of variation of the advance as a function of the quantity of fuel delivered and the engine rpm. In addition, the practical manufacture of the cam is considerably simplified.

Lastly, the separation of the planar cam from its attendant supporting slider makes it possible to replace the cam in action without having to dismember the governor.

Figure 2:
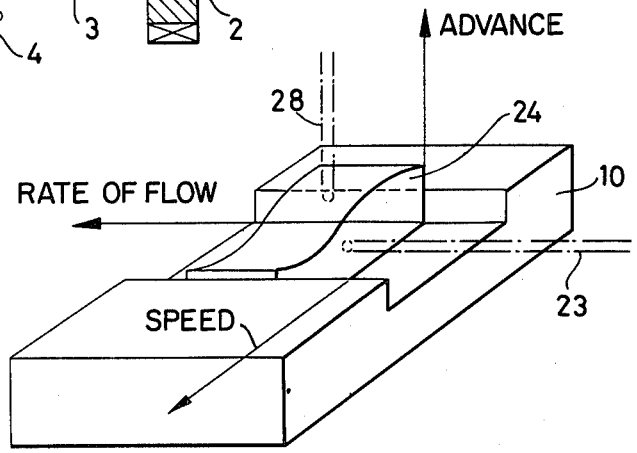

The structural and functional features of the invention and its advantages over the prior art will become more clearly apparent from the scrutiny of the ensuing exemplary disclosure, aided by the accompanying drawings, wherein:

FIG. 1 is a diagrammatical showing which illustrates the device for the automatic regulation of the advance made according to the principles of the present invention, and FIG. 2 is a perspective view showing the slider on which the regulation cam is mounted.

Having now reference to the drawings, a driving shaft 1 is rotated synchronously with the engine and, by the gear 2, drives to rotation a gear 12 keyed to the shaft 17 and carrying centrifugal masses 16.

The masses 16, as is well known, are subjected to the centrifugal force and are active upon the end of the sleeve 18 against the bias of a spring 19, on the other end of which a cam 20 is active, which is connected to an outer lever 21, the latter thus permitting that the load of the spring on the centrifugal governor may be varied.

A fuel feeding pump or feed pump 14 is driven by the gear 12 via any conventional linkage (not shown). Said feed pump 14 of the paddle type draws fuel from the tank 4 through the conduit 3 and urges it pressurally through the delivery channel 5, which is connected by a bypass conduit to the chamber 6 of a regulation valve 15, in which a counteracting piston 8, biassed by a spring 9, regulates the pressure in said chamber 6 and discharges the excess fuel through the pipe 7 into the reservoir 4. The conduit 5 feeds a conventional injection pump, not shown.

A channel 37 branches off from the chamber 6 and reaches the cylinder 26 in which a piston 25 is reciprocable, which rests against a slider 10 slidable within a guideway 11 and is biassed by a spring 27.

On the slider 10 a planar tridimensional cam 24 is mounted, which can be shifted transversally of the movement of the slider in a guideway 13 of its own, but still follows the motion of the slider 10 along the axis of the guideway 11. The crosswise movement of the cam 24 is brought about by the lever 23, which, by being swung about a pivotal point 22, transfers the drive of the sleeve 18 to the cam 24.

Against the surface of the cam 24 a feeler 28 is mounted, which acts continuously and perpendicularly to the two movements aforementioned, viz. the longitudinal and the transversal ones, and which commands the hydraulic actuator generally indicated at 50.

The feeler 28 transfers its drive to the plunger 29, which slides witin a seating 43 as formed on the advance-piston 30 and the latter, by being reciprocated within a cylinder 33 against the bias of a spring 32, can move the control member, pinion or gear 31 which is conventionally connected to the members which regulate the instant of time at which the delivery of fuel commences towards the injection pump (not shown).

The pressure obtaining in the chamber 6, through the channel 35, enters the chamber 42 into which the passageway 44 opens and, by the agency of the circular groove 40 formed on the surface of the plunger 29, can reach the chamber 39 via the conduit 34. A duct 36 provides to discharge the fuel towards the reservoir 38 by opening in correspondence with a second groove 41 on the distribution plunger 29 and with the space 45 which is comprised between said distribution plunger and the cylinder 43 internally on the advance piston 30. In practice, the plunger 29 acts like a distributor to selectively connect the chamber 39 either to the duct 35 or to the discharge at 38, so that the piston 30 follows the position of the piston 29 as imposed by the cam 24.

In its normal operation, the driving shaft 1 causes the gear 12 of the governor to be rotated and the masses 16 displace the sleeve 18 consistently with the speed against the bias of the springs 19.

The fuel feed pump 14 has a delivery under a pressure which is limited by a valve 15. This pressure, as is well known, is increased as the engine rpm is increased consistently with the pressure drops existing within the valve 15 itself, so that said pressure is a signal of the engine rpm.

Such a pressure, transferred through the channel 37, urges the piston 25 against the spring 27 and thus moves the slider 10 with its cam 24 in the direction of the axis of the cylinder 26.

The position of the sleeve 18, through the lever 23, shifts the cam 24 transversally and, inasmuch as the position of the sleeve 18 is a function of the rate of flow delivered by the injection pump (not shown) governed thereby, it is apparent that the cam 24 feels said rate of flow of the pump together with the rpm thereof.

The tridimensional profile provided on the surface of the planar cam 24 is followed continuously by the feeler 28, which, via the servomechanism 50, imparts a rotary motion to the control member 31 which controls the advance of the injection pump (not shown).

It is thus apparent that the longitudinal posture of the cam is governed by the pressure of delivery of the pump 14 and this position of the cam is a function of the rpm.

The transversal posture of the cam on its slider 10 is a function of the position of the sleeve 18, which is the member which adjusts the unitary rate of flow of the injection pump. The height of the cam as a function of the two parameters viz. rpm and rate of flow, is determined by its shape and makes it possible to correct the advance properly according to the objects of the invention, as shown in FIG. 2.

It has been shown in the drawings that it is possible to obtain a cam motion which is responsive to the engine rpm by exploiting the delivery pressure of the feed pump, by profiting of a phenomenon which is experienced in the conventional pumps.

The speed signal, however, can be obtained in an equivalent manner for the purposes of this invention, but by differently designed means, for example as disclosed in a copending patent application by the same applicants thereof.

Additional changes can be introduced in what has been described in the foregoing, without departing from the scope of the invention.

I claim:

1. A control device for adjusting the instant of time of the start of the delivery in an injection pump for an internal combustion engine comprising means responsive to the rpm of a fuel pump for displacing a slider in a first direction, said slider slidably carrying a cam body thereon, means responsive to the rate of flow delivered by an injection pump for moving said cam body in a second direction perpendicular to said first direction relative to said slider, said cam body having a cam surface against which rests a feeler, said feeler being mounted for movement by said cam surface in a third direction perpendicular to said first and second directions, and control means responsive to movement of said feeler for effecting the start of the delivery of said injection pump.

2. The control device as defined in claim 1 wherein said cam body is of the planar type.

3. The control device as defined in claim 1 including means for controlling the rate of flow of said injection pump, said injection pump flow rate controlling means including a driven rotatable member, centrifugal masses pivotally carried by said rotatable member in functional response to the speed of said rotatable member, a sleeve member mounted for movement of said centrifugal masses in a first direction, means for creating a biasing force against said sleeve member in a direction opposite said last-mentioned first direction, and said flow rate responsive means being constructed and arranged to be moved by said sleeve member.

4. The control device as defined in claim 1 wherein said rpm responsive means includes a piston mounted for reciprocal movement in a cylinder, said piston being constructed and arranged to move said slider in said first direction, and means for introducing fuel from said fuel pump into said cylinder.

5. The control device as defined in claim 1 wherein said rpm responsive means includes a piston mounted for reciprocal movement in a cylinder, said piston being constructed and arranged to move said slider in said first direction, means for introducing fuel from said fuel pump into said cylinder, and the spring means for biasing said piston in a direction opposite said first direction.

6. The control device as defined in claim 1 wherein said control means is at least in part defined by a hydraulic mechanism.

7. The control device as defined in claim 1 wherein said control means includes a hydraulic actuator including a cylinder receiving therein a piston, said piston being connected to said feeler at one side thereof, means for delivering fuel from said fuel pump into said cylinder to a side of said piston opposite said one side to effect with feeler movement relative movement of said cylinder, and means for transforming the latter movement to effect the start of the delivery of said injection pump.

8. The control device as defined in claim 2 wherein said control means includes a hydraulic actuator including a cylinder receiving therein a piston, said piston being connected to said feeler at one side thereof, means for delivering fuel from said fuel pump into said cylinder to a side of said piston opposite said one side to effect with feeler movement relative movement of said cylinder, and means for transforming the latter movement to effect the start of the delivery of said injection pump.

9. The control device as defined in claim 3 wherein said control means includes a hydraulic actuator including a cylinder receiving therein a piston, said piston being connected to said feeler at one side thereof, means for delivering fuel from said fuel pump into said cylinder to a side of said piston opposite said one side to effect with feeler movement relative movement of said cylinder, and means for transforming the latter movement to effect the start of the delivery of said injection pump.

10. The control device as defined in claim 4 wherein said contriol means includes a hydraulic actuator including a cylinder receiving therein a piston, said piston being connected to said feeler at one side thereof, means for delivering fuel from said fuel pump into said cylinder to a side of said piston opposite said one side to effect with feeler movement relative movement of said cylinder, and means for transforming the latter movement to effect the start of the delivery of said injection pump.

11. The control device as defined in claim 5 wherein said control means includes a hydraulic actuator including a cylinder receiving therein a piston, said piston being connected to said feeler at one side thereof, means for delivering fuel from said fuel pump into said cylinder to a side of said piston opposite said one side to effect with feeler movement relative movement of said cylinder, and means for transforming the latter movement to effect the start of the delivery of said injection pump.

* * * * *

UNITED STATES PATENT AND TRADEMARK OFFICE

CERTIFICATE OF CORRECTION

PATENT NO. : 4,432,326

DATED : February 21, 1984

INVENTOR(S) : Manuel Roca-Nierga

It is certified that error appears in the above-identified patent and that said Letters Patent is hereby corrected as shown below:

---[73] Assignee: SPICA S.p.A. Livorno, Italy.---

Signed and Sealed this

*Eighth* Day of *May 1984*

[SEAL]

*Attest:*

GERALD J. MOSSINGHOFF

*Attesting Officer*

*Commissioner of Patents and Trademarks*